US006145679A

United States Patent [19]

Walters

[11] Patent Number: 6,145,679

[45] Date of Patent: Nov. 14, 2000

[54] SHIFTABLE TAIL-BLOCK LOGGING SKYLINE

[76] Inventor: Victor Walters, P.O. Box 250, Sechelt, British Columbia, Canada, V0N 2A0

[21] Appl. No.: 09/320,361

[22] Filed: May 19, 1999

Related U.S. Application Data

[63] Continuation-in-part of application No. 08/920,354, May 30, 1997, abandoned, which is a continuation-in-part of application No. 08/597,997, Feb. 7, 1996, abandoned.

[51] Int. Cl.[7] ..... B66C 21/00

[52] U.S. Cl. ..... 212/76; 212/87; 212/94; 212/97

[58] Field of Search ..... 212/313, 80, 87, 212/88, 89, 90, 91, 92, 93, 94, 95; 244/33, 31; 52/146, 155, 165

[56] References Cited

U.S. PATENT DOCUMENTS

| | | | |
|---|---|---|---|
| 725,770 | 4/1903 | Probasco | 52/146 |
| 3,221,897 | 12/1965 | Matheson . | |
| 3,346,127 | 10/1967 | Pelton et al. . | |
| 4,756,431 | 7/1988 | Hirano | 212/76 |
| 5,080,302 | 1/1992 | Hoke | 244/31 |

*Primary Examiner*—Thomas J. Brahan
*Attorney, Agent, or Firm*—David J. French

[57] ABSTRACT

A skyline operates on a mountain side from an upper tail-block that is positionable along a transverse cable extending between two elevated anchor points. A balloon is attached to the upper tail-block to assist in supporting the weight of the skyline cable, and also the weight of the drop line carriage mounted on the skyline.

4 Claims, 6 Drawing Sheets

SHIFTABLE TAIL-BLOCK LOGGING SKYLINE

This is a Continuation-in-Part application of application Ser. No. 08/920,354 filed May 30, 1997 which in turn is a Continuation-in-Part of application Ser. No. 08/597,997 filed Feb. 7, 1996.

FIELD OF THE INVENTION

This invention relates to logging on sloping terrain using skylines. More particularly, it relates to a new skyline configuration that will provide an increased lateral span of coverage on timber slopes logged by a skyline.

BACKGROUND TO THE INVENTION

Logging with skylines is an old, established technology. With the increased ecological pressures for selective logging, and the need to reach lumber on higher slopes, considerable scope exists to further exploit skyline logging, particularly if improvements are adopted over traditional techniques.

Generally, skylines are provided with an upper "tail-block" that is mounted on a post at the top of a slope to be logged extending downslope to a yarder or winch control system at its lower end. Such a tail-block arrangement is inherently fixed and limits the span of hill side that can be reached with a traditional skyline.

Proposals have been made for arrangements by which the upper terminal of a winching system may be shifted laterally to increase the terrain accessed by the winch. Examples include U.S. Pat. Nos. 95,611; 700,321; 1,489,448; 1,782,043; 3,270,895; 3,706,385; 3,499,544; 4,756,431; and Italian Patent 472,294. The references described, however, deal with tail-blocks which are in fixed positions until relocated, Such tail-blocks are not laterally adjustable in a controllable manner during logging.

U.S. Pat. No. 3,499,544 in particular shows a winch system in which an uphill winch tethered to a tree is supported vertically by pulleys that can transverse laterally, to a small degree, along a supporting cable 15. Such small motion may occur spontaneously in response to lateral loads, but they are not controllable laterally. The winch is said to be "shiftable" on the cable 13 (column 2, lines 53–56). As the winch in this patent is anchored to a tree or stump by a chain-stay 39 (column 3, line 25) such shifting must refer to the manual repositioning of the winch by disconnecting it from one portion of the cable 13. Thus, this arrangement lacks a tail-block positioning control system, for controllably positioning the winch laterally at specific locations along the transverse line.

U.S. Pat. Nos. 1,489,448 and 3,706,385 similarly describe a tail-block which is shiftable laterally to a series of separate positions. However, once fixed in each position, the tail-block in this disclosure is not controllable laterally during logging.

A further reference of interest is U.S. Pat. No. 3,333,713. This reference shows a traversing cable-supported hoist. In this reference two main lines extend in approximate parallel relationship up a slope. A lifting carriage in positioned between these two lines, supported by carriage-supporting cables extending to each line. These cable lengths are variable, allowing the position of the carriage laterally to be controlled. This system does not provide, however, for the shifting laterally of the two tail-blocks fixed at the upper ends of each of the main lines.

One object of this invention is, therefore, to provide a skyline for logging slopes wherein the position of the upper tail-block is shiftable laterally in a controllable manner to permit the tail-block to be located at selected positions transversely across a hillside during logging.

Balloons and kites have also been used for logging wherein their function is to lift the load of a log that is to be removed from a tract of lumber. United States patents that have issued in this category include: U.S. Pat. Nos. 3,221,897 3,270,895 3,326,392 3,270,895 3,346,127 3,359,919 3,369,673 3,448,864 3,706,385 3,807,577 3,865,251 4,055,319 4,640,474 5,080,302.

It has been recognized in such applications that control lines are required to position the balloon over a log to be lifted, and to transfer the log to the valley bottom for loading on to trucks. Patents U.S. Pat. No. 3,807,577 and U.S. Pat. No. 5,080,302 particularly address this issue.

A balloon-logging operation with control lines differs from a skyline in that the balloon control lines are not expected to carry any significant lifting loads. In a skyline,, however, the cables are expected to carry such loads. U.S. Pat. No. 3,706,385 particularly combines a balloon with a skyline in order to counteract the weight of the log-lifting carriage. While the use of a balloon-assist in a skyline system is therefore known, significant benefits are available by the combination of a balloon or balloons as part of the invention hereafter described.

The invention in its general form will first be described, and then its implementation in terms of specific embodiments will be detailed with reference to the drawings following hereafter. These embodiments are intended to demonstrate the principle of the invention, and the manner of its implementation. The invention in its broadest and more specific forms will then be further described, and defined, in each of the individual claims which conclude this Specification.

SUMMARY OF THE INVENTION

In its most general form, the invention is based on a skyline cable that terminates at an upper skyline tail-block that is supported through a pulley attached to a transverse cable that is, in turn, anchored at its two ends at separated, transverse-line anchors, positioned at elevated locations, e.g. high on a mountainside, thereby providing support for the skyline cable. The lateral position of the skyline tail-block on the transverse line or cable is controllable, as by means of lateral tail-block control lines, during logging.

The base end of the skyline, while shiftable in position when logging is not occurring, remains stationary during logging. The repositioning of the skyline during logging is, according to the invention, achieved by lateral movement of the skyline tail-block on the transverse line.

The invention further incorporates one or more balloons tethered to the skyline system. In particular, a balloon is connected to the upper tail-block of the skyline cable where this tail-block connects to the transverse cable. By placing a balloon at this location a portion of the "dead-weight" of the skyline cable system will be spared from burdening the transverse cable, e.g. the weights of the main cable and of the log-lifting carriage need not all be carried by the transverse cable. This increases the lifting capacity of this balloon-enhanced skyline system.

A second balloon may also be attached to a drop-line carriage carried by the principle skyline cable. Any tendency of the carriage to mount the skyline cable under the lifting force of the balloon when free of a load may be resisted by the fact that the carriage is attached to a controllable skyline.

The second balloon coupled to the drop line carriage on the skyline need not develop a lifting force sufficient to carry the full weight of the log. Rather, the load of lifting logs is carried by the combination of the balloons and skyline together.

A carriage-coupled balloon can serve a further use when the skyline log is descending under the influence of its own weight. In such a case the balloon will provide an aerodynamic drag akin to that of a parachute acting as a brake. If a supplementary balloon haul-back line is employed, then as more and more of the balloon haul-back line is spooled-up, the net lifting effect of the balloon will increase, thereby providing additional resistance to the descent of the log as it nears the bottom tail-block. During the descent, the drop-line, if winch-supported, may also be extended in order to cause the butt-end of the log to drag on the ground, providing a further braking action.

The position of the carriage laterally over the hill side may be controlled by a tail-block control line that positions the skyline tail-block laterally along the transverse upper cable. This tail-block positioning means may be in the form of a separate, double, returning cable running between both transverse-line anchors and the tail-block. Or a single line may be employed using gravity to shift the tail-block in the opposite direction. Such control may also be obtained by doubling the transverse cable itself to provide a returning portion of the transverse cable that may be shifted in a loop by rotation of a transverse line anchoring sheave at one end of the transverse line. Due to the relatively lower power requirements involved in shifting the tail-block when no logs are being lifted, an up-slope positioned motor may control this anchor sheave in response to signals provided by radio transmissions; or lines may be run to a winch or winches at the base end of the skyline.

Ideally, the two ends of the transverse cable may be anchored directly, or through upper transverse line anchor sheaves, on mountain outcroppings that are proximate to the slope to be logged. They may also be anchored to elevated posts set into the mountain sides. A preferred anchoring system relies on steel rods set into drilled holes in a rock out-crop. The exposed ends of the rods are embedded in concrete and an encircling band or sleeve is joined to the transverse line.

The spacing between anchor points in all cases is intended to be substantial. By providing a transverse line of on the order of 5,000 feet in length, an enormous span of coverage can be obtained for positioning the drop-line carriage over a mountain slope below. Further, increased coverage may be obtained by shifting the bottom tail-block of the skyline in the valley below when logging is not occurring.

As a preferred means for lifting logs, the skyline carriage is provided with a drop-line, which may be of fixed length. Alternately, the carriage may be provided with a winch to lower the drop-line to the forest floor to retrieve a log.

A preferred arrangement for the skyline is to provide a returning cable, like a clothesline, with two cable lengths being used to carry the weight of the carriage. By attaching the carriage to one of the lines its position up and down the slope may be controlled by winches at the base end.

The transverse cable carries the load of the skyline, the skyline carriage and the logs to be lifted. This cable is slackened to allow a "V" to form therein in order to carry the load. This "V" is directed down the slope being logged towards the winches located at the base end of the skyline.

It is important that the transverse tail-block line be rigged with considerable degree of slack to reduce the mechanical amplification of load being applied to the tail-anchor blocks. Transverse cable stresses will be amplified by the shallowness of the "V" that forms, increasing with the departure of the main skyline cable angle from the vertical and with the opening of the angle of the "V" formed in the transverse line where it carries the skyline tail block. This amplification will place significant stress on the anchors located at the ends of the transverse line.

Once the carriage is positioned over logs to be lifted, the skyline cable may be allowed to sag, preferably as much as possible, in order to assist in dropping a choker or lift-line to pick-up a log. The choker line may optionally be winched-in by a winch in the drop-line carriage to take up slack. In doing so the carriage and slackened skyline may be drawn-down towards the log. The actual lifting effect is then developed by the increase in the main, skyline cable tension. Because the tail-block is shiftable, the carriage may be positioned nearly over the log to be lifted. The carriage, if one is employed need not, therefore, have the power capacity to drag logs sideways, as would be required under existing systems.

The result of using, a skyline anchored at a shiftable upper tail-block which can travel transversely along the transverse tail-block line, combined optionally with at least one balloon that is coupled to the upper tail-block, provides benefits that these elements would lack independently. This new system of logging will have increasing relevance in the future as ecological concerns increase.

The foregoing summarizes the principal features of the invention and some of its optional aspects. The invention may be further understood by the description of the preferred embodiments, in conjunction with the drawings, which now follow.

DESCRIPTION OF THE PREFERRED EMBODIMENT

Figure 1:
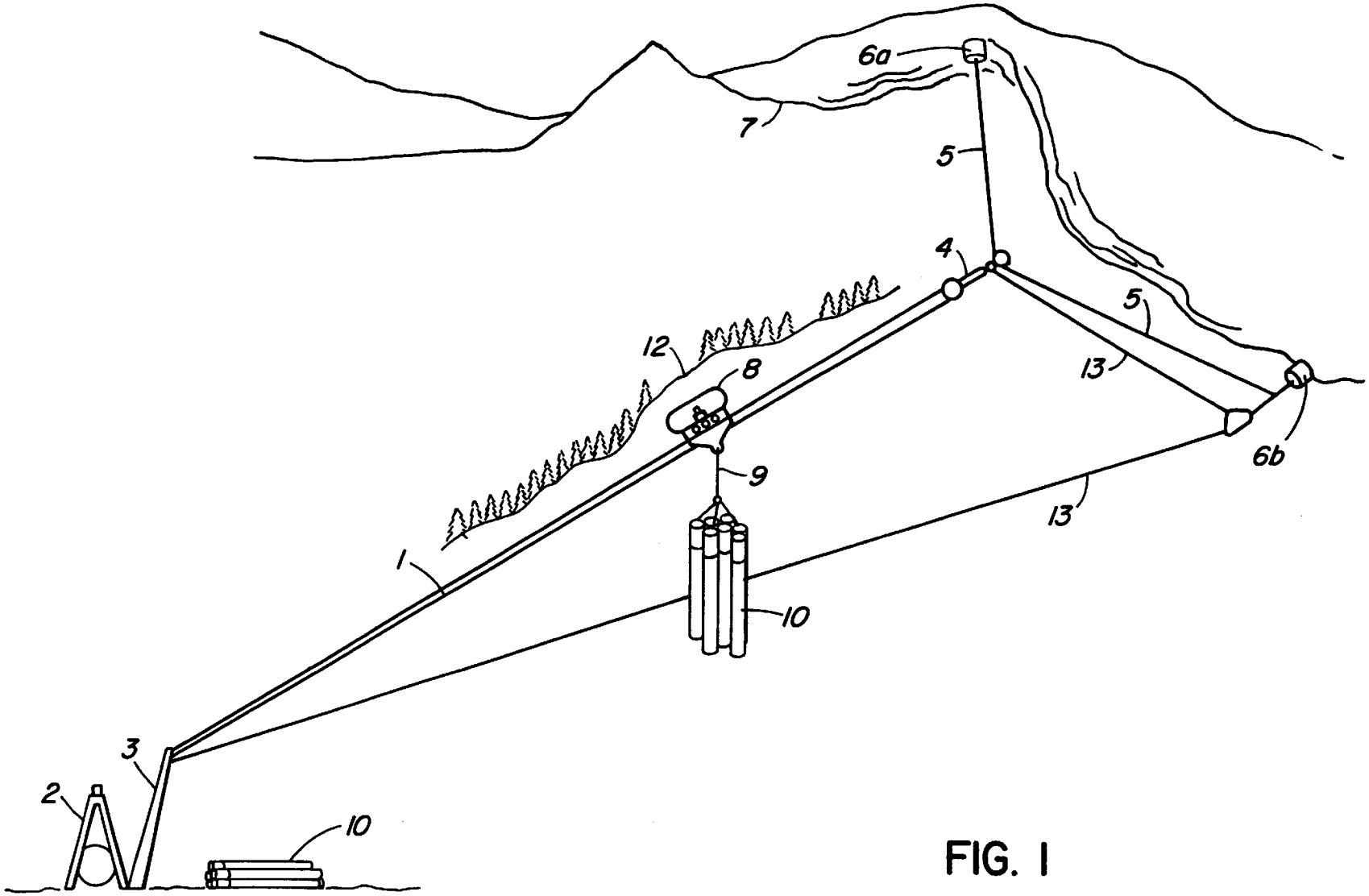
FIG. 1 is a pictorial view of a skyline according to the invention positioned on the side of a steep timbered slope.

In FIG. 1 a main skyline cable 1 extends on a return basis from a powered capstan system 2, represented by a yarder 3, at its lower end to an upper tail-block 4. The tail-block 4 is carried by a transverse tail-block line 5 that extends between two upper transverse line anchors 6*a*, 6*b*. Those anchors 6*a*, 6*b* are widely separated at elevated locations, preferably at mountain side rock out-cropping 7.

A log carriage 8 on the main skyline cable 1 carried by both portions of the returning line 1 is able, through a drop-line 9, to raise logs 10 for transport to the yarder 3. Use of a return cable format for the skyline cable 1 wherein both lines pass through and support the carriage 8 and wherein the tail-block sheave absorbs the line loads will allow up to double the load capacity of the system over use of a single cable. Further, use of a return cable system allows the carriage 8 to be shifted upwardly over the slope 12 to be logged, and to be dropped to retrieve the logs being lifted by slackening-off one or both of the returning lines.

Figure 2:
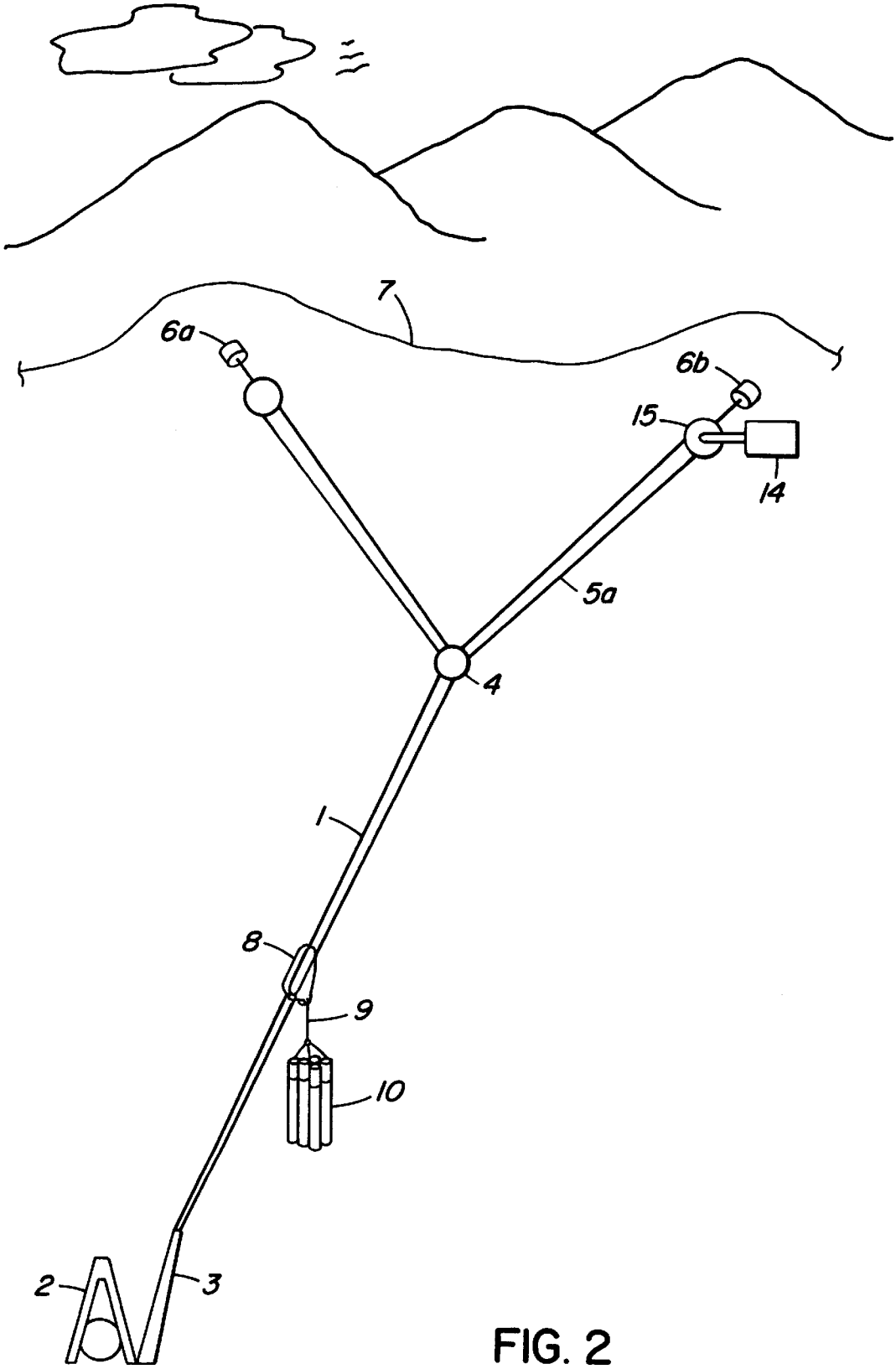
FIG. 2 is a plan view of the system employed in FIG. 1 with a doubling of the transverse tail-block line and a different positioning system.

The position of the tail-block 4 along the transverse tail-block cable 5 may, in one variant, be controlled by a tail-block control cable 13 that extends up from the yarder 3. In FIG. 1, anchor transverse line 6*b* is higher than anchor 6*a* so that the tail-block control cable 13 pulls against the effects of gravity. Alternately, as shown in FIG. 2, the transverse tail-block cable 5 may be doubled on a returning basis, in which case a motor 14 may power a sheave 15 at the place of one anchor 6*b*. By circulating the returning transverse tail-block line 5*a*, the lateral position of the tail-block 4 may be controlled. Such control may be effected while logging is taking place.

Lifting of logs 10 is effected in FIG. 1 by slackening the skyline 1 at the yarder winch to lower a fixed drop-line 9 for attachment to the logs 10. The logs 10 are lifted by taking-up the slack in the skyline 1.

Figure 3:
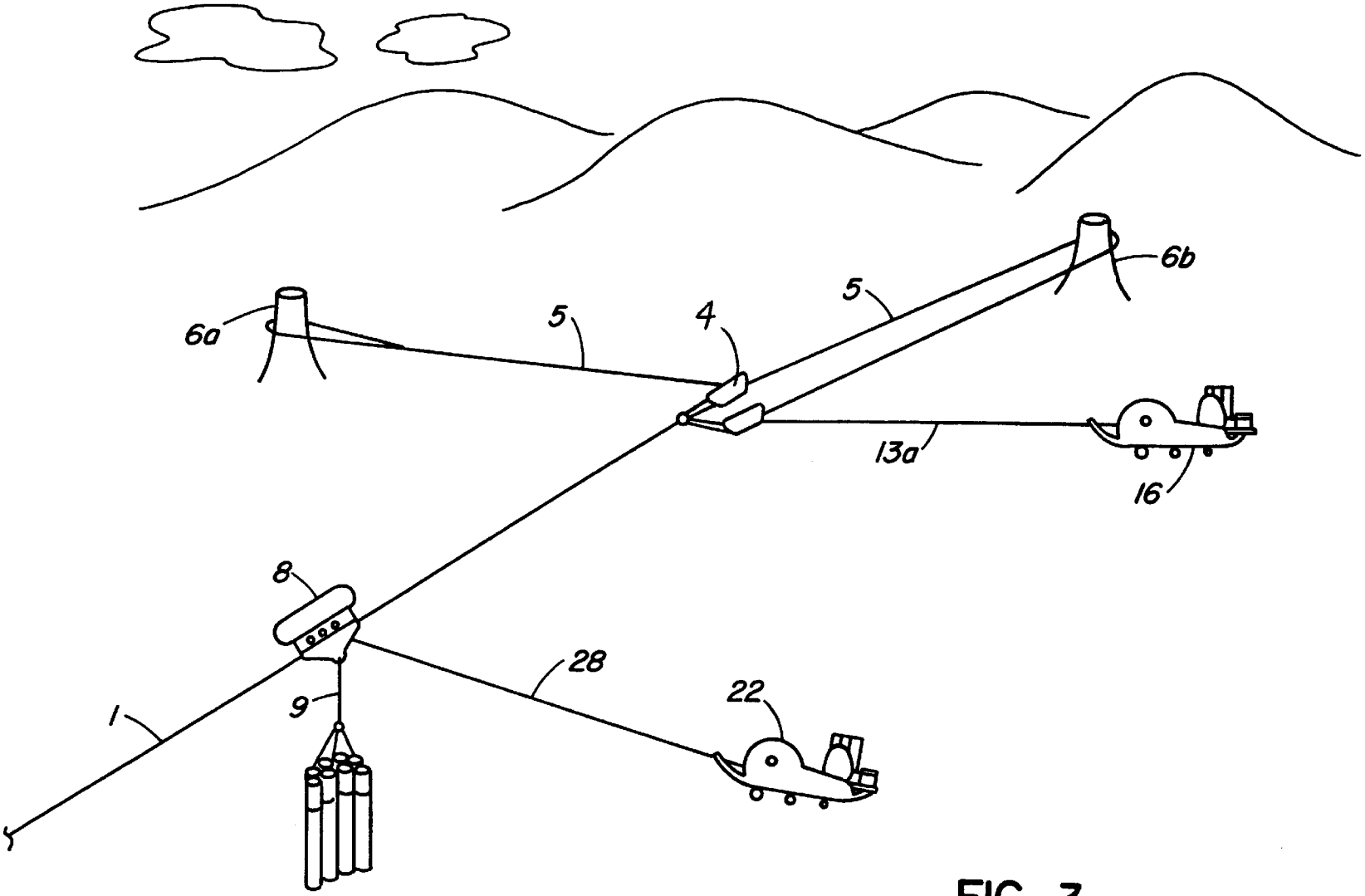
FIG. 3 is a pictorial view of the use of a transversely travelling tail-block in combination with a prior art "Wyssen"™-type carriage system.

In FIG. 3 an alternate log-lifting carriage 8 control arrangement of the type employed by Wyssen of Switzerland is depicted in association with a single cable skyline. Carriage position is controlled by separate cables (not shown). In the Wyssen system an uphill winch 22 positioned on a sled controls the drop-line 9 through a drop-line control line 28. This arrangement, while it will work, is not desirable. It has the disadvantage of loading the skyline 1 with the weight of the drop-line control line 28. For this reason, a returning skyline 1 is preferred.

A sled-mounted capstan 16 control can, however, usefully be employed to the position of the tail-block 4 on the transverse tail-block 4 line 5 through a tail-block control line 13*a*. Under gravity the tail-block 4 tends to move to the lower end 6*a* of the transverse line 5 and the control line 13*a* resists this tendency.

In the present invention, the dual tail-block line anchors 6*a*, 6*b* must support both the weight of the skyline and of the transverse tail-block cable 5, together with the amplification factors arising from the geometry of the skyline and tail line lay-outs. The presence of one or more balloons within the system can remove the greater part of these stresses from the upper dual tail-block anchors 6*a*, 6*b* freeing them up to absorb lifting loads as logs are being recovered.

Figure 4:
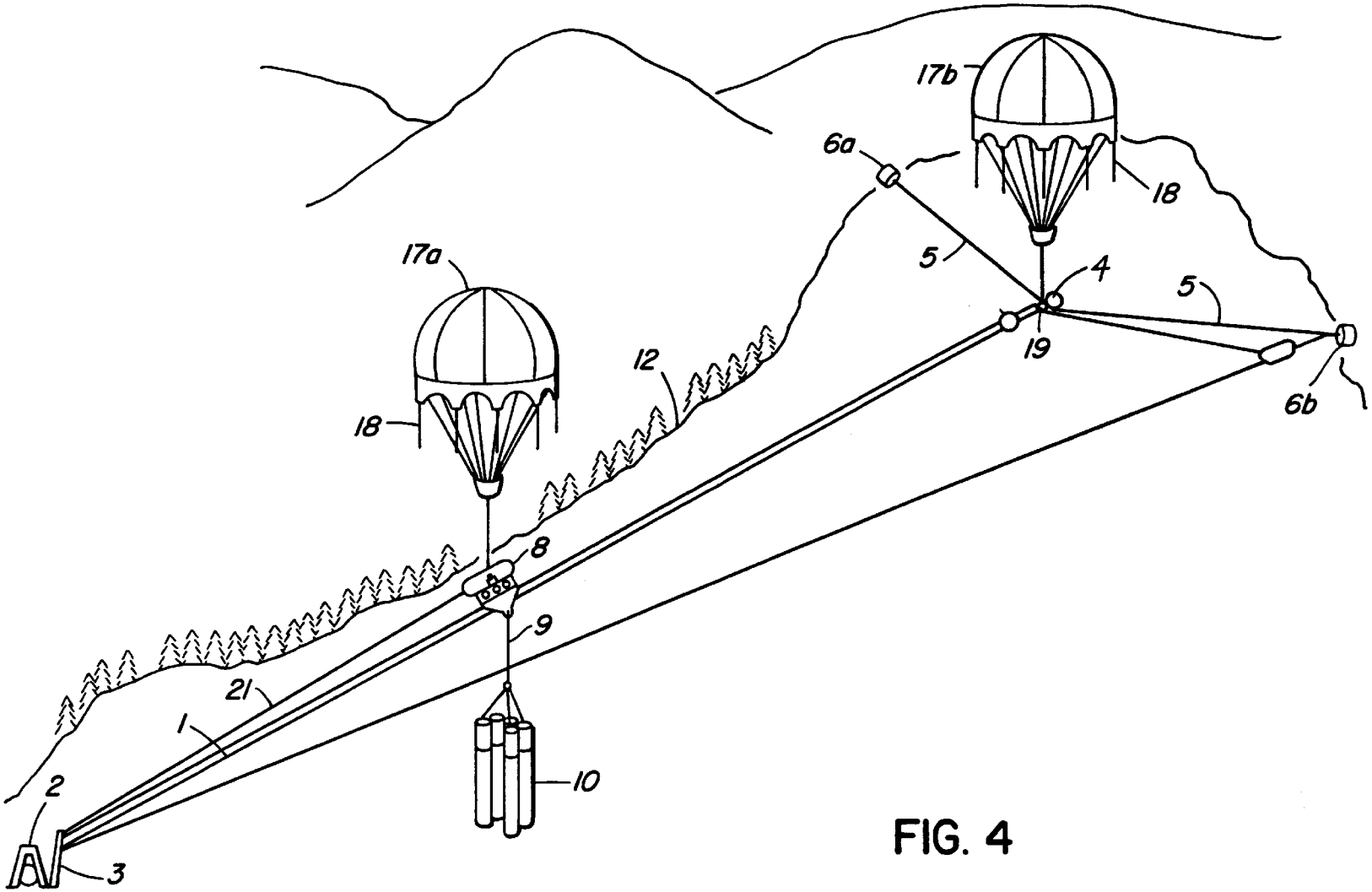
FIG. 4 is a pictorial view of the skyline system of FIG. 1 incorporating two balloons to provide lift.

In FIG. 4, the system of FIG. 1, is modified by the addition of balloons 17*a*, 17*b*. While two balloons 17*a*, 17*b* are shown, both and either, are optional.

One balloon 17*a* is coupled to the carriage 8. This balloon may optionally have sufficient lift to carry the carriage up the slope 12. Its role is to provide a partial lifting force to reduce the tension in the skyline cable 1 when logs 10 are raised from the slope 12. A carriage haul-back line 21 is shown in FIG. 4 as an alternate arrangement to using a rotating returning skyline 1 for positioning the carriage.

A further advantage of the use of a balloon 17*a* coupled to the carriage 8 itself is that its lifting force can exceed the weight of the drop line carriage 8 and its own haul-back line 21, causing the balloon 17*a* to tend to travel spontaneously up the skyline 1. This action can be restrained by the balloon haul-back line 21 when the balloon 17*a*, with its drop line carriage 8, reaches the correct elevation.

The second balloon, 17*b* is attached to the tail-block 4. Its role is to reduce the tension in the transverse tail-block lines 5 arising both from the lifting of logs 10 and from the inherent weight of the skyline 1.

Both balloons 17*a*, 17*b* may have tethers 18 to allow them to be anchored for storage overnight. The tail-block balloon 17*b* may be connected to the tail-block 4 by a coupling 19 that is disengageable when the carriage 8 contacts it, in order to transfer this tailblock balloon 17*b* to the carriage 8 for further transfer to the base of the skyline 1 at night or during storms, for storage.

Figure 5:
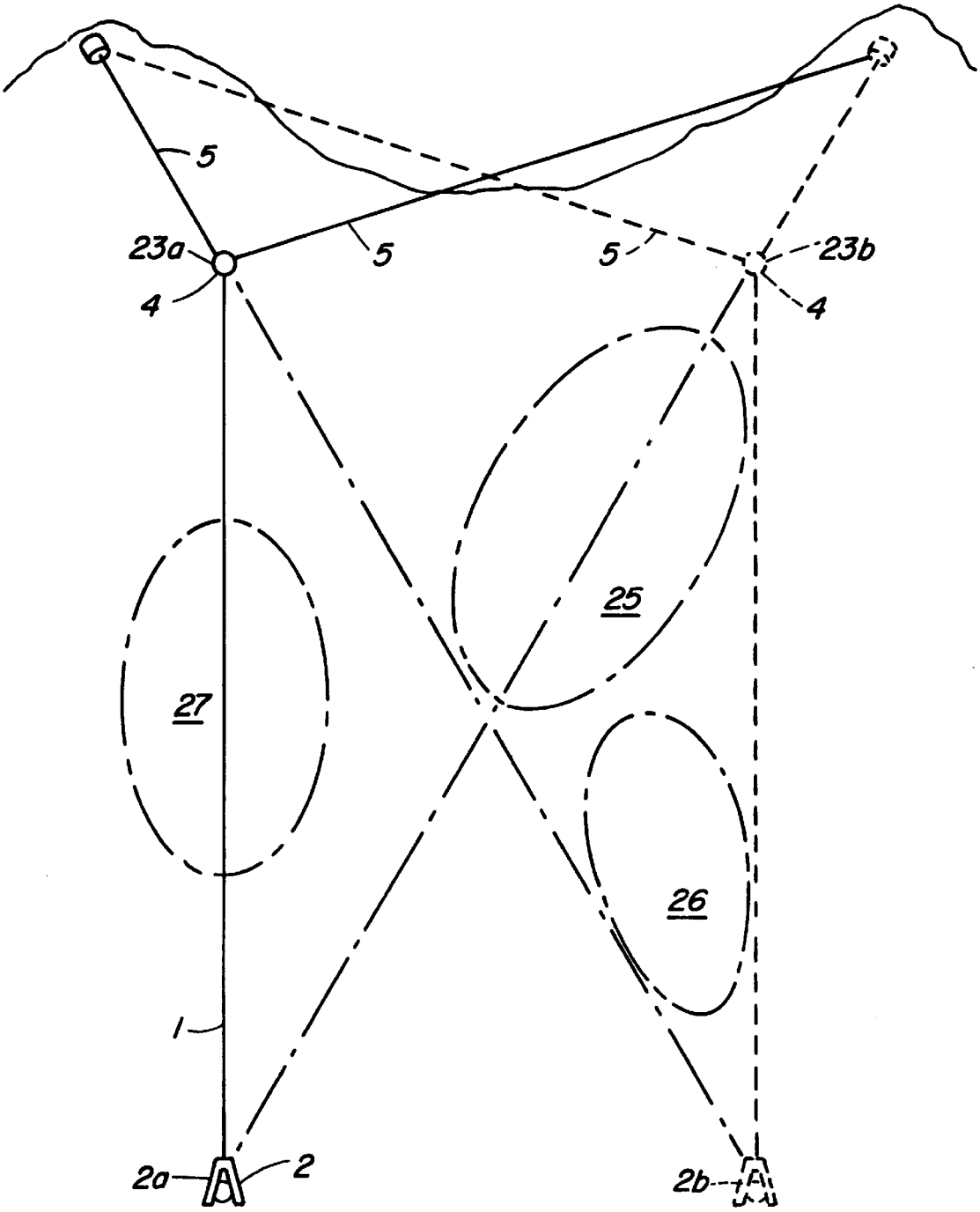
FIG. 5 is a further plan view of the system of FIG. 2 showing the span of ground that is accessible by shifting both the tail-block and the base capstans of the skyline of the invention.

In FIG. 5, the tail-block 4 is shown in two positions 23*a*, 23*b* on the transverse tail-block line 5. And the base capstan 2 is shown at two, separate positions 2*a*, 2*b*. Normally, the span of access of a skyline 1 would be limited to some hundreds of feet on either side of the skyline 1 as shown generally by region 27. After such area has been logged, the line 1 has to be shifted. While shifting the base capstan 2 is not complicated be located at a lower level, the shifting of the higher tail-block 4 would normally be more complex if the present invention were not employed.

In FIG. 5 the additional area 25 is made accessible by shifting the tail-block 4 between its two positions 23*a*, 23*b*. And the further area 26 is accessed by then shifting the base capstan 2 from position 2*a* to position 2*b*. These areas 25, 26 are more readily accessible through use of the invention than would be possible with existing skyline systems.

It is important that transverse cables 5 be well anchored in order to carry the extensive loads to which they are exposed. One way to effect this is to provide an anchoring system as depicted in FIG. 6.

Figure 6:
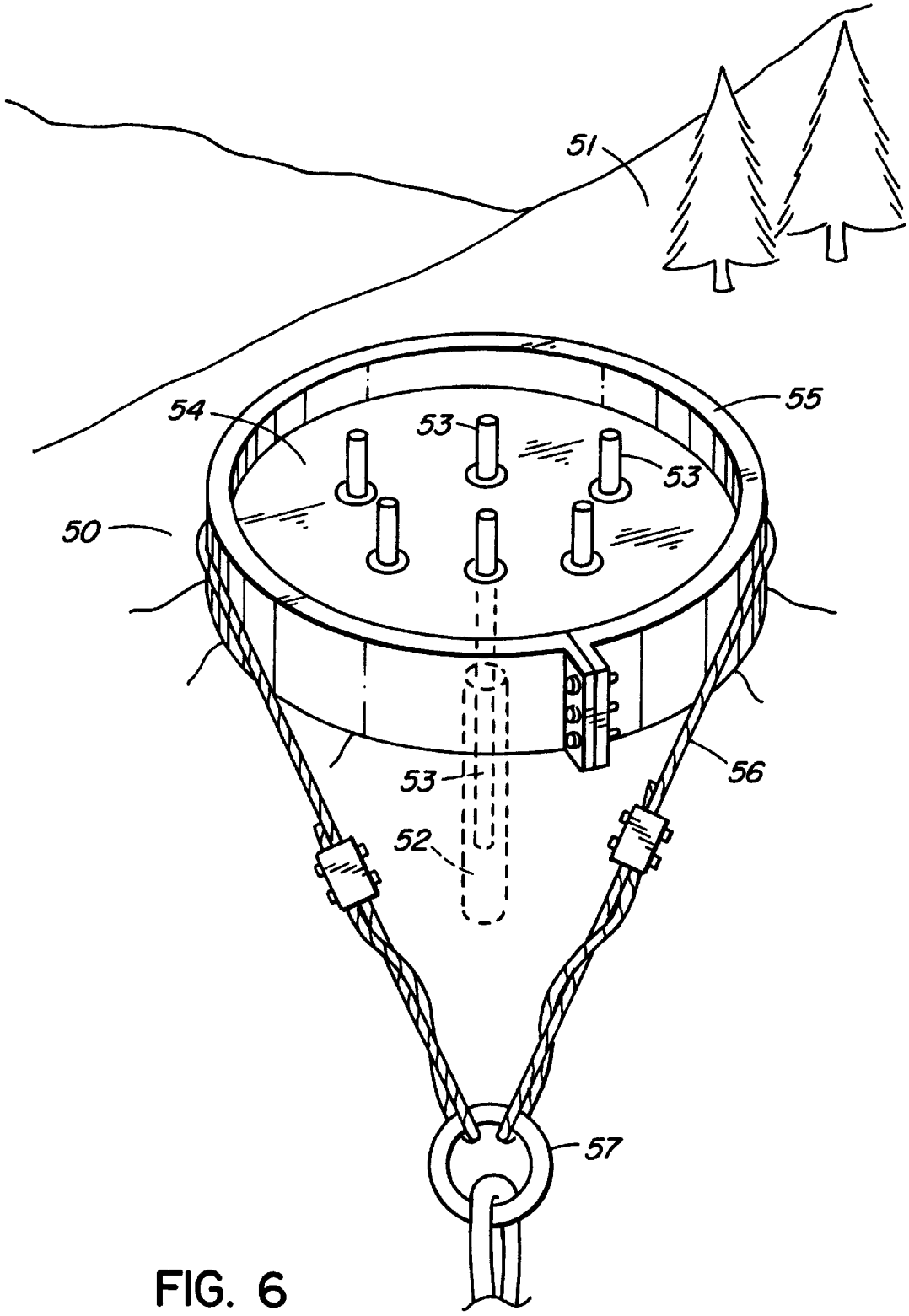
FIG. 6 depicts an anchoring system for the ends of the transverse line.

In FIG. 6 a cleared portion of the surface 50 of a solid hill or mountain side 51 has drilled into it, preferably to bed rock, holes 52 into which are grouted heavy gauge steel bars 53. While six such bars 53 are shown as many may be employed as are needed, so long as they are sufficiently spaced to hold without developing inter-hole fractures.

The protruding portions of the bars are encased in a concrete bed 54 that is in turn surrounded by an encircling steel sleeve 54. While shown as being a closed circle, the sleeve 55 need only directly bear against the upper side of the concrete bed 54 and, therefore, need not constitute a closed circle. A closed configuration for this sleeve 55 is, however, convenient as it may serve as a form for the pouring of the concrete bed 54.

The concrete bed 54 serves to transfer a load applied to the sleeve 55, as by partially encircling cable 56, to the steel bars 53. The concrete bed 54 also serves to limit the load applied to the steel bars 53 to a virtually pure shear force—i.e. the tendency for a bending torque to be applied to the bars 53 is minimized.

The ends of the encircling cable 54 are fastened to a shackle 57 which is, in turn, connected to one end of the transverse cable 5 (not shown). In this way, an anchorage can be provided for the transverse cable 5 which is capable of sustaining enormous loads.

CONCLUSION

The foregoing has constituted a description of specific embodiments showing how the invention may be applied and put into use. These embodiments are only exemplary. The invention in its broadest, and more specific aspects, is further described and defined in the claims which now follow.

These claims, and the language used therein, are to be understood in terms of the variants of the invention which have been described. They are not to be restricted to such variants, but are to be read as covering the full scope of the invention as is implicit within the invention and the disclosure that has been provided herein.

The embodiments of the invention in which an exclusive property are claimed are as follows:

1. A skyline logging system for logging sloped timber-bearing terrain comprising;

(1) a skyline cable that terminates at its upper end at an upper skyline tail-block that incorporates a pulley and, at its lower end, at a skyline base end for receiving logs;

(2) a transverse tail-block support cable which terminates at its two ends at transverse-line anchors at separated elevated locations on elevated terrain located entirely above the upper end of the skyline cable and above the timber-bearing terrain to be logged, and which carries the tail-block by the tail-block pulley, providing support for the skyline cable;

(3) skyline tail-block positioning means for controlling the location of the skyline tail-block along the transverse tail-block support cable during logging;

(4) a log carriage mounted on said skyline cable for lifting a load of logs, said log carriage being positionable on the skyline cable by cable means extending to the skyline base end; and (5) a balloon connected to the skyline tail-block to carry a portion of the weight of the skyline cable system components.

2. A skyline logging system as in claim 1 further comprising a second balloon coupled to the log carriage to carry a portion of the carriage weight.

3. A skyline logging system as in claim 1 wherein the transverse-line anchors comprise:

(a) rigid bars that penetrate into the ground and have protruding portions that extend above the ground;

(b) encasing concrete positioned around the protruding portions of the bars and having an upper side portion;

(c) an encircling sleeve extending around at least the upper side portion of the encasing concrete; and (d) coupling joining means coupling the encircling sleeve to the transverse block support cable.

4. A skyline logging system as in claim 2 wherein the transverse-line anchors comprise:

(a) rigid bars that penetrate into the ground and have protruding portions that extend above the ground;

(b) encasing concrete positioned around the protruding portions of the bars and having an upper side portion;

(c) an encircling sleeve extending around at least the upper side portion of the encasing concrete; and (d) coupling joining means coupling the encircling sleeve to the transverse block support cable.

* * * * *